US010919670B1

(12) United States Patent
Chicaia

(10) Patent No.: US 10,919,670 B1
(45) Date of Patent: Feb. 16, 2021

(54) TAMPERPROOF SEAL FOR SEALING CONTAINERS

(71) Applicant: Gervasio A. Chicaia, Richmond, TX (US)

(72) Inventor: Gervasio A. Chicaia, Richmond, TX (US)

( * ) Notice: Subject to any disclaimer, the term of this patent is extended or adjusted under 35 U.S.C. 154(b) by 0 days.

(21) Appl. No.: 16/666,115

(22) Filed: Oct. 28, 2019

Related U.S. Application Data

(63) Continuation-in-part of application No. 15/850,904, filed on Dec. 21, 2017, now abandoned.

(51) Int. Cl.
*B65D 41/34* (2006.01)
*B65D 55/08* (2006.01)

(52) U.S. Cl.
CPC ..... *B65D 41/3442* (2013.01); *B65D 55/08* (2013.01)

(58) Field of Classification Search
CPC ..... B65D 41/3442; B65D 55/08; B65D 55/0863; B65D 41/3452; B65D 51/002
USPC ..... 215/251, 232, 258
See application file for complete search history.

(56) References Cited

U.S. PATENT DOCUMENTS 2,153,426 A * 4/1939 McNamara ..... B65D 55/022 215/252
4,474,301 A * 10/1984 Davis ..... B65D 50/041 215/220
4,494,664 A * 1/1985 Guala ..... B65D 41/3409 215/252
4,501,373 A * 2/1985 Heinlein ..... B65D 41/3452 215/252
4,667,836 A * 5/1987 McLaren ..... B65D 41/3414 215/216
5,048,706 A 9/1991 de Vaujany
5,273,173 A * 12/1993 Debetencourt .... B65D 41/3447 215/252
5,397,009 A * 3/1995 Salmon ..... B65D 41/3428 215/252
6,938,787 B2 * 9/2005 Shinozaki ..... B65D 41/3452 215/252
7,513,377 B1 * 4/2009 Culley ..... B65D 41/3428 215/252

(Continued)

FOREIGN PATENT DOCUMENTS

CA 1162881 A 2/1984

*Primary Examiner* — J. Gregory Pickett
*Assistant Examiner* — Niki M Eloshway
(74) *Attorney, Agent, or Firm* — Sanchelima & Associates, P.A.; Christian Sanchelima; Jesus Sanchelima

(57) ABSTRACT

A system for a tamperproof seal having a cap assembly and a bottle assembly is disclosed. The bottle assembly includes a bottle with a neck and bottle threads. The cap assembly includes a cap with a top portion and a bottom portion which engage the neck of the bottle. Between the top and bottom portion there is a seal created. The seal is initially intact and only broken once the top and bottom portion are separated. The seal cannot be replaced once it has been broken. If the seal is broken reaching the intended party, then tampering occurred. The top portion may be removably mounted to the bottle. The top portion includes inner threads that engage the bottle threads. The bottom portion includes inner teeth angled towards each other which engage the bottommost of bottle threads. Inner teeth prevent the replacing of the cap once the seal is broken.

13 Claims, 5 Drawing Sheets

(56) References Cited

U.S. PATENT DOCUMENTS

| | | | | |
|---|---|---|---|---|
| 2006/0124575 | A1* | 6/2006 | Mavin | B65D 5/746 215/252 |
| 2006/0169666 | A1* | 8/2006 | Nyman | B65D 1/0246 215/252 |
| 2007/0051691 | A1* | 3/2007 | Hidding | B65D 41/46 215/252 |
| 2009/0301986 | A1* | 12/2009 | Phelan | B65D 51/1688 215/252 |

* cited by examiner

TAMPERPROOF SEAL FOR SEALING CONTAINERS

OTHER RELATED APPLICATIONS

The present application is a continuation-in-part and claims the benefit of the priority date of the pending U.S. patent application Ser. No. 15/850,904, filed on Dec. 21, 2017, which is hereby incorporated by reference.

BACKGROUND OF THE INVENTION

Field of the Invention

The present invention relates to a tamperproof seal, more particularly, to a tamperproof seal for sealing different types of containers.

Description of the Related Art

Capped containers, such as different drink bottles, oil, gas or milk containers, laboratory/hospital/chemical/medicinal containers, are likely to be tampered as they travel from the source to the consumers. To overcome tampering, capped containers are sealed. Some of the available seals that are generally used are heat shrink bands, labels and liners. Heat shrink bands and labels are used to external seal capped containers by wrapping them around cap and container, while, liners are internal seals provided within cap on the open portion of neck of container. When tampered, such seals get torn-off and may not be of any further use. Many-a-times such tampered seals provide less tampering indication or evidence on capped containers if tampered seal is replaced with a new seal of similar type, which can be easily done.

Several designs of various tamperproof seals for sealing capped containers have been designed in the past. None of them, however, include a tamperproof seal for sealing capped containers which provides tampering indication and evidences and also a tamperproof seal which is impossible to be replaced on same tamperproof sealed capped container once it has been tampered with.

Applicant believes that a related reference corresponds to U.S. Pat. No. 5,048,706 issued to Manufacture Lyonnaise De Bouchage, titled "Means for Tamperproof Sealing of A Container" which discloses a cap having a cylindrical skirt with a central opening and sealed with a tear-off lid. The tear-off lid when opened breaks open the skirt and provides evidence. However, the document differs from the present invention because of complexity and cost involved for manufacturing of the skirt-type cap. Applicant believes another related reference corresponds to Canadian patent No. CA1162881 issued to Charles S. Ochs, Anchor Hocking Corporation, Carl E. Koontz for "Tamperproof Bottle Closure Cap" which discloses a tamper indicating band that seals the closure cap to a bead on the container. However, the structure of tamper indicating band and its fitment is complex. Also, in both of the documents the seals are externally positioned and there can be chances of seals being replaced or manipulated to hide evidence of tampering.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a tamperproof seal for sealing capped containers.

It is another object of the present invention to provide a tamperproof seal that has few components which are simple in structure, has easy sealing fitment and is not susceptible of being inadvertently removed and if once removed cannot be readily replaced.

It is another object of this invention to provide a tamperproof seal for sealing capped containers that when tampered leaves indications or evidence of tampering having taken place.

It is another object of the present invention to provide a tamperproof seal which can be retrofitted onto different containers.

It is still another object of this invention to provide a tamperproof seal for sealing capped container the components of which are easy to manufacture and cost-effective.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
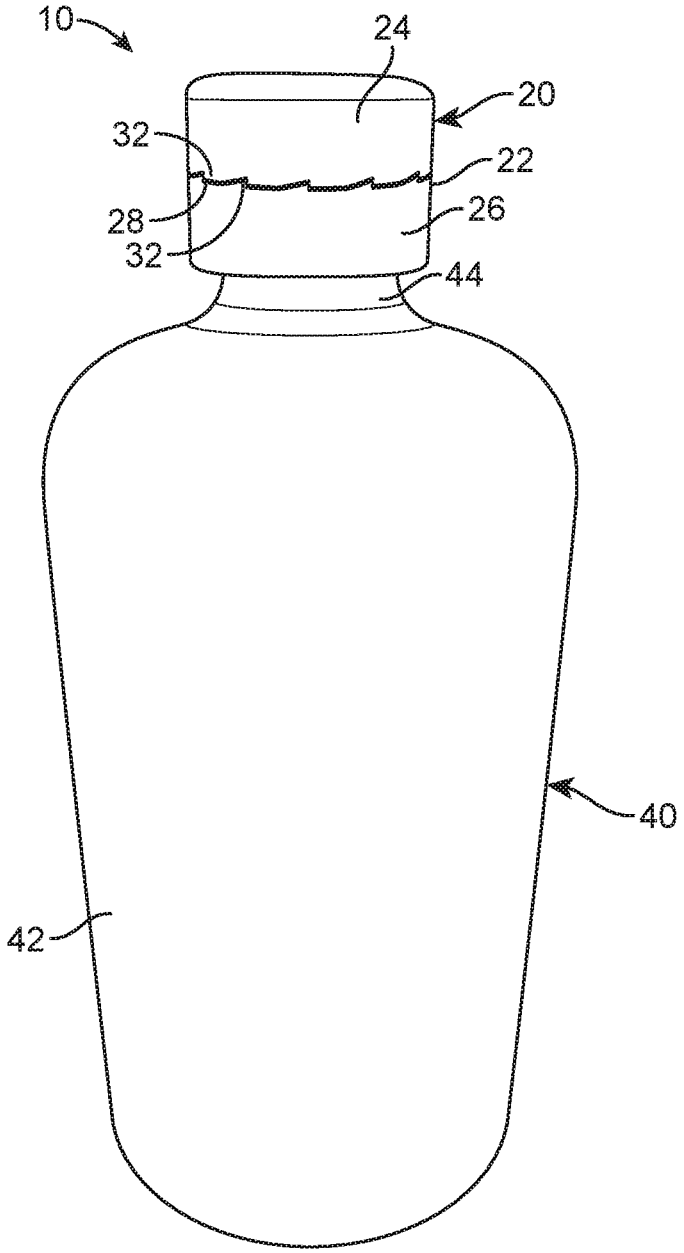
FIG. 1 represents operational setting in which the cap assembly 20 is mounted to the bottle assembly 40.
Figure 2:
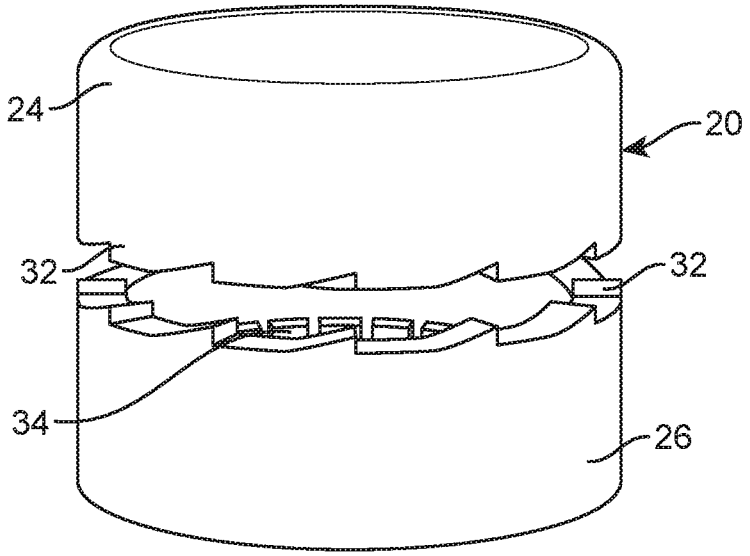
FIG. 2 shows an isometric view of the cap 22 of the cap assembly 20.
Figure 3:
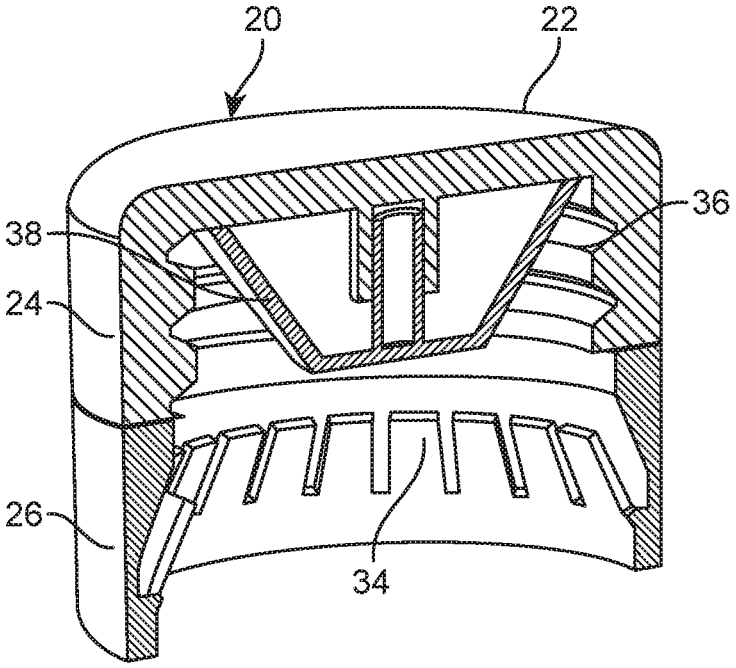
FIG. 3 illustrates a cross sectional view of the cap 22 of the cap assembly 20 showing the interior of the cap 22.
Figure 4:
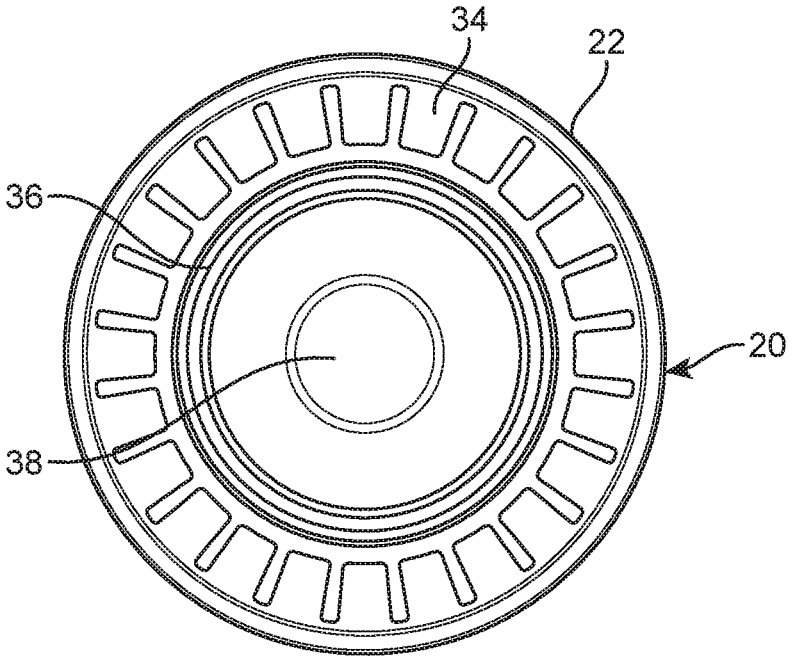
FIG. 4 represents a bottom view of the cap 22 of the cap assembly 20.
Figure 5:
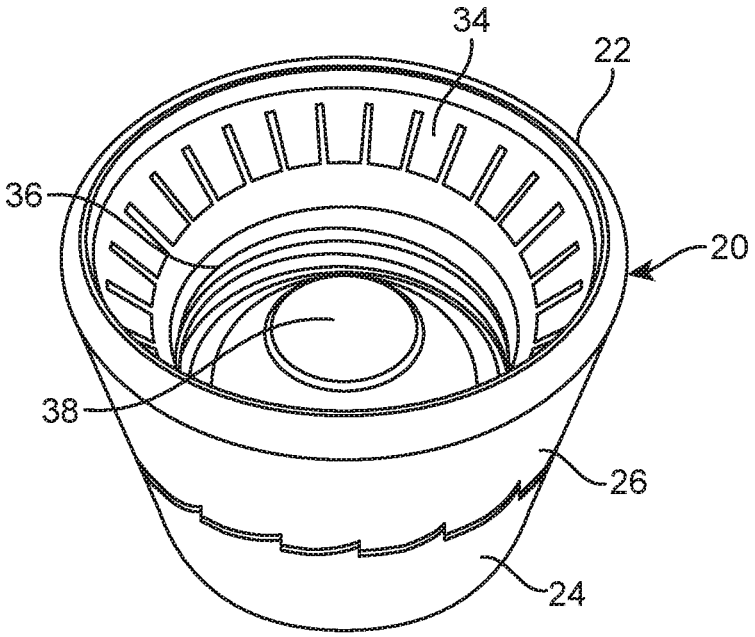
FIG. 5 represents an angled bottom view of the cap 22 to better show the inner member 38 of the cap 22.
Figure 6:
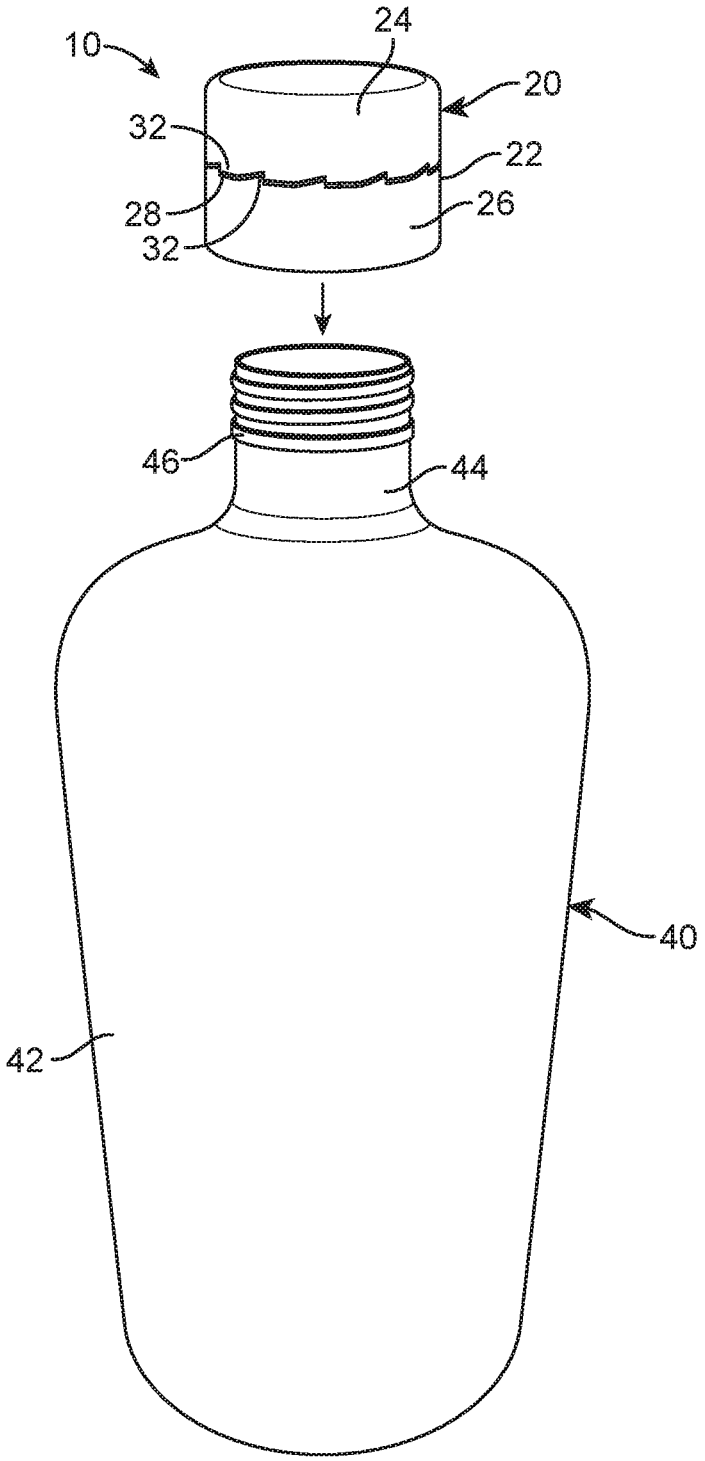
FIG. 6 shows an isometric view of the bottle 42 of the bottle assembly 40 before the cap 22 of the cap assembly 20 is retrofitted onto the bottle 42.
Figure 7:
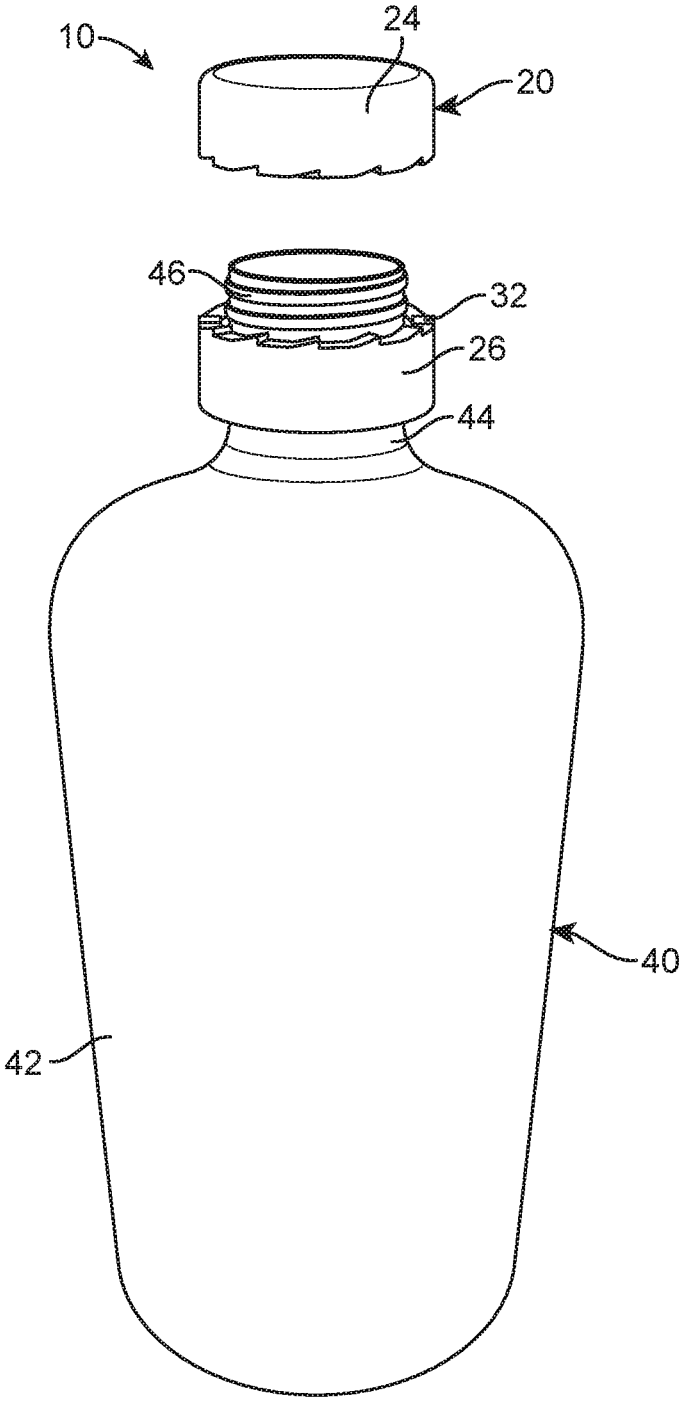
FIG. 7 illustrates the seal 28 of the cap 22 being broken.

Referring now to the drawings, FIGS. 1 to 7, where the present invention is generally referred to with numeral 10, it can be observed that a tamperproof seal 10 includes a cap assembly 20 and a bottle assembly 40.

It can be seen that the present invention importantly includes cap assembly 20 which aids in maintaining bottles, oil, gas or milk containers, laboratory/hospital/chemical/medicinal containers or the like sealed and tamperproof. Cap assembly 20 may include cap 22 which has a seal 28 that is tamperproof. In one embodiment, cap 22 may be made of plastic, however, cap 22 may be made of other suitable materials. Importantly, cap 22 may have a top portion 24 and a bottom portion 26. Cap 22 may be of predetermined dimensions and materials. Cap 22 may preferably be circular. However, it should be understood that cap 22 is not limited to being circular. Top portion 24 and bottom portion 26 may be of a same circumference and diameter. Each of top portion 24 and bottom portion 26 may include outer teeth 32 along a circumference thereof. Outer teeth 32 on top portion 24 may be adapted to correspond and cooperate with outer teeth 32 on bottom portion 26 as they are to engage one another. In one embodiment, outer teeth 32 may be jagged.

However, it should be understood that outer teeth 32 may be of predetermined shape and dimensions. Outer teeth 32 may be located at a bottom side of top portion 24 and on a top side of bottom portion 26. Outer teeth 32 allow for top portion 24 and bottom portion 26 to be disengaged only if turned in one predetermined direction. Seal 28 on cap 22 may be created at the meeting point between top portion 24 and bottom portion 26 when top portion 24 and bottom portion 26 are fabricated and engaged. Upon initial fabrication, top portion 24 and bottom portion 26 may be attached to one another at seal 28 as cap 22 is fabricated with seal 28 intact. In one embodiment, seal 28 may be a kiss cut seal. Seal 28 may be broken once top portion 24 and bottom portion 26 are separated or detached from one another. In order to break seal 28, it is necessary to twist top portion 24 and bottom portion 26 in opposite directions or have one of top portion 24 or bottom portion 26 twisted as the opposite portion remains stationary. Once seal 28 has been broken it is not possible to replace or reverse. Seal 28 being broken by users that are not authorized would indicate tampering has taken place. Once tampering has been detected, it is understood that the authorized user should proceed with caution as contents in the containers may have been altered or tampered with. Bottom portion 26 may further include inner teeth 34 along an inner perimeter. Inner teeth 34 may be adapted to engage a container. Inner teeth 34 may be of a predetermined shape and dimensions. In one embodiment, inner teeth 34 may be rectangular shaped. Inner teeth 34 are preferably evenly spaced apart. It should also be understood that inner teeth 34 may be angled or sloped. Timer teeth 34 should be slight flexible as to be pressed inwardly as cap 22 engages a container or neck portion thereof. Preferably inner teeth 34 may be slopped upwardly and towards each other. Top portion 24 may include a threaded portion 36 along an interior perimeter. Threaded portion 36 may be located along the entire inner perimeter of top portion 24. Top portion 24 may further include an inner member 38. Inner member 38 may protrude downward from top portion 24. In one embodiment, inner member 38 may be tapered.

It can be seen that the present invention further includes bottle assembly 40. Bottle assembly 40 may be adapted to cooperate with cap assembly 20. It can be seen that bottle assembly 40 may include bottle 42 adapted to hold contents as needed by a user. The contents in bottle 42 may be sensitive materials which need protecting from tampering. Bottle 42 may include a neck 44 having bottle threads 46 along a perimeter of neck 44. Cap 22 may be attached to bottle 42 at neck 44. As cap 22 is mounted to bottle 42, inner teeth 34 may slide down neck 44 until inner teeth 34 are below the lower most of bottle threads 46. Bottom portion 26 may extend to a base of neck 44. This results in bottle 42 being tamper proof once cap 22 is attached. It may be possible to access the interior of bottle 42 by separating top portion 24 and bottom portion 26. Once top portion 24 and bottom portion 26 are separated, seal 28 is no longer intact and it may not be possible to replace seal 28. This aids in indicating whether bottle 42 and cap 22 were tampered with if seal 28 is broken before it reaches the proper authority that is to break seal 28. Inner teeth 34 may make it difficult to easily remove cap 22 from bottle 42, more specifically bottom portion 26 from neck 44. This aids in preventing someone from breaking seal 28 and tampering with the contents within bottle 42 and then easily replacing cap 22 with a new of cap 22 having an intact seal 28. Inner teeth 34 may allow cap 22 to be easily attached to bottle 42, but not easily removed. The slight angle at which inner teeth 34 are at prevents removal of bottom portion 26 by simply pulling upwardly as inner teeth 34 remain engaged to the bottom most of bottle threads 46 at all times. Threaded portion 36 may cooperate with and engage bottle threads 46. This further secures cap 22 to bottle 42. Bottom portion 26 may not be intended for easy removal but top portion 24 can be detached and reattached even after seal 28 has been broken. Top portion 24 may be twisted onto neck 44. This allows for the authorized user to open and close bottle 42 to obtain or replace the contents within bottle 42 that they are working with, in possibly a medical setting, for example. Seal 28, however, remains broken. Inner member 38 may be adapted to provide an airtight seal within bottle 42. Inner member 38 may cooperate with an opening found at the top of bottle 42 or at the top of neck 44, more specifically, which leads to the interior of bottle 42.

It should be understood that cap assembly 20 may be made of plastic. However, it should be understood that cap assembly 20 may also be made of stainless steel, aluminum, rubber or the like. It should also be understood that cap assembly 20 is not limited to being circular as depicted in the immediate embodiment. Bottle assembly 40 may preferably be made of glass. Bottle assembly 40 may further be made transparent, semitransparent or opaque. It may be suitable for bottle assembly 40 to be made of other materials such as plastic, aluminum, rubber or the like. Bottle 42 may preferably be made of materials that are safe for the contents stored inside of bottle 42. The goal is to be able to transport contents in a way that prevents tampering and if tampering does occur it is easily recognized. Bottle 42 may be reused once seal 28 has been broken. Presumably by the authorized user that initially broke seal 28 but must continue to experiment with the contents or samples within bottle 42. Contents can easily be removed and replaced once seal 28 is broken.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a tamperproof seal, comprising:

a. a bottle assembly including a bottle having a neck and bottle threads extending about a perimeter of said neck;

b. a cap assembly including a cap, said cap including a top portion and a bottom portion, said top portion and said bottom portion being of a same width, said cap initially including a seal between said top portion and bottom portion, said seal being broken once said top portion and said bottom portion are separated, said top portion including a threaded portion along an entire interior circumference thereof, said threaded portion having a threaded portion height and extending an entire height of said top portion, said bottom portion including inner teeth extending entirely about an inner circumference of said bottom portion, said inner teeth being angled a predetermined amount upwardly and towards each other, said inner teeth being interconnected in abutting contact with each other along a bottom portion of each of said inner teeth, an open slit extending between each of said inner teeth and defining said inner teeth, said inner teeth including a flat distal end, said open slit having a slit width, said slit width being less than a tooth width of each of said inner teeth, said top portion including an inner plug member within extending downwardly therefrom, said inner plug member entirely surrounded by said threaded portion along a plug member circumference of said inner plug member, said inner plug member having an inner plug member height and extending the entire height of said top portion, said threaded portion height and said inner plug member height being equal, said threaded portion being entirely above of said inner teeth; and c. said cap with said seal intact being mounted to said neck, said top portion engaging said neck by having said threaded portion engage said bottle threads, said bottom portion engaging said neck by having said inner teeth engage the bottommost of said bottle threads, said bottom portion being permanently mounted to said neck once said inner teeth engage said neck, said top portion being removably attachable to said neck once said seal is broken, said seal adapted to indicate tampering of said seal if said seal is broken before reaching an authorized user, said inner plug member penetrating a predetermined depth into said bottle through said neck when said neck is engaged by said top portion.

2. The system of claim 1, wherein said top portion and said bottom portion include outer teeth which cooperate with each other when said top portion and bottom portion engage each other.

3. The system of claim 2, wherein said outer teeth are jagged and slanted diagonally.

4. The system of claim 2, wherein said top portion has said outer teeth along a bottom side of said top portion.

5. The system of claim 2, wherein said bottom portion has said outer teeth along a top side of said bottom portion.

6. The system of claim 1, wherein said inner plug member is tapered.

7. The system of claim 1, wherein said inner plug member creates an airtight seal within said bottle when said top portion has engaged said bottle at said neck.

8. The system of claim 1, wherein said seal is a kiss cut seal.

9. The system of claim 1, wherein said inner teeth are equidistant from each other.

10. The system of claim 1, wherein said bottom portion of said cap partially covers said bottle threads.

11. The system of claim 1, wherein said inner plug member includes an inner portion received within a centrally located channel of said top portion to secure said inner plug member to said top portion.

12. The system of claim 1, wherein said inner plug member is truncated.

13. A system for a tamperproof seal, consisting of:

a. a bottle assembly including a bottle having a neck and bottle threads extending about a perimeter of said neck;

b. a cap assembly including a cap, said cap including a top portion and a bottom portion, said top portion and said bottom portion being of a same width, said cap initially including a seal between said top portion and bottom portion, said seal being broken once said top portion and said bottom portion are separated, said top portion including a threaded portion along an interior circumference thereof, said threaded portion having a threaded portion height and extending an entire height of said top portion, said bottom portion including inner teeth extending entirely about an inner circumference of said bottom portion, said inner teeth being angled a predetermined amount upwardly and towards each other, said inner teeth being interconnected in abutting contact with each other along a bottom portion of each of said inner teeth, an open slit extending between each of said inner teeth and defining said inner teeth, said inner teeth being equidistant from each other, said inner teeth including a flat distal end, said open slit having a slit width, said slit width being less than a tooth width of each of said inner teeth, said top portion including an inner plug member within extending downwardly therefrom, said inner plug member entirely surrounded by said threaded portion along a plug member circumference of said inner plug member, said inner plug member having an inner plug member height and extending the entire height of said top portion, said threaded portion height and said inner plug member height being equal, said threaded portion being entirely above of said inner teeth, said top portion and said bottom portion include outer teeth which cooperate with each other when said top portion and bottom portion engage each other, said outer teeth are jagged, said top portion has said outer teeth along a bottom side of said top portion, said bottom portion has said outer teeth along a top side of said bottom portion, said inner plug member creates an airtight seal within said bottle when said top portion has engaged said bottle at said neck, said inner plug member penetrating a predetermined depth into said bottle through said neck when said neck is engaged by said top portion, said seal is a kiss cut seal; and c. said cap with said seal intact being mounted to said neck, said top portion engaging said neck by having said threaded portion engage said bottle threads, said bottom portion engaging said neck by having said inner teeth engage the bottommost of said bottle threads, said bottom portion being permanently mounted to said neck once said inner teeth engage said neck, said top portion being removably attachable to said neck once said seal is broken, said seal adapted to indicate tampering of said seal if said seal is broken before reaching an authorized user, said bottom portion partially covering said bottle threads.

* * * * *